US006962518B2

(12) United States Patent
Wang

(10) Patent No.: US 6,962,518 B2
(45) Date of Patent: Nov. 8, 2005

(54) MOTION TOY

(75) Inventor: Feng-Hsiung Wang, Hsi-Chih (TW)

(73) Assignee: Chain Fong Toys Co., Ltd., Taipei Hsien (TW)

( * ) Notice: Subject to any disclaimer, the term of this patent is extended or adjusted under 35 U.S.C. 154(b) by 0 days.

(21) Appl. No.: 10/770,535

(22) Filed: Feb. 4, 2004

(65) Prior Publication Data

US 2005/0170747 A1 Aug. 4, 2005

(51) Int. Cl.[7] ..... A63H 13/02
(52) U.S. Cl. ..... 446/330; 446/376; 446/383
(58) Field of Search ..... 446/293, 294, 446/330, 376, 383, 390

(56) References Cited

U.S. PATENT DOCUMENTS

| | | | | |
|---|---|---|---|---|
| 3,331,463 A * | 7/1967 | Kramer | 180/8.6 |
| 4,186,517 A * | 2/1980 | Kuhn et al. | 446/330 |
| 4,610,639 A * | 9/1986 | Piazza | 446/327 |
| 5,290,185 A * | 3/1994 | Murakami | 446/334 |
| 6,012,962 A * | 1/2000 | Arriola | 446/376 |
| 6,022,263 A * | 2/2000 | Liu et al. | 446/379 |
| 6,171,169 B1 * | 1/2001 | Saunders | 446/308 |
| 6,375,536 B1 * | 4/2002 | Yang | 446/353 |
| 6,482,068 B2 * | 11/2002 | Lee et al. | 446/376 |
| 6,589,095 B1 * | 7/2003 | Tsai | 446/330 |
| 6,645,035 B1 * | 11/2003 | Tsai | 446/330 |

* cited by examiner

*Primary Examiner*—Kien Nguyen

(57) ABSTRACT

A motion toy is disclosed to have a swinging mechanism adapted to simulate the swinging action of the wings of a bird, the swinging mechanism including a driving module, two swinging arm assemblies symmetrically coupled the driving module at two sides, two endpieces respectively coupled to the swinging arm assemblies remote from the driving module, and coupling devices coupling the swinging arm assemblies to the driving module and the endpieces to the swinging arm assemblies for enabling the swinging arm assemblies to swing and the endpieces to follow the swinging arm assemblies to swing upon operation of the driving module.

20 Claims, 9 Drawing Sheets

MOTION TOY

BACKGROUND OF THE INVENTION

1. Field of the Invention

The present invention relates to toys and, more particularly, to a motion toy, which comprises a swinging mechanism that simulate the swinging action of the wings of a bird.

2. Description of the Related Art

There are commercially available motion toys that simulate walking, singing, or any of a variety of actions of a human being when the user switched on the power switch. These motion toys commonly use a motor to move gears and eccentric shaft members, causing movable parts to move. The motion of these conventional motion toys is monotonous and not fine.

FIGS. 8 and 9 show a motion toy according to the prior art. According to this design, the motion toy A is shaped like a duck, comprising a body A1, a head A2 vertically movably coupled to the front top side of the body A1, two wings A3 fastened pivotally with the body A1 at two opposite lateral sides, two legs A4 affixed to the bottom side of the body A1, and a tail A5 horizontally movably coupled to the rear side of the body A1, a motor drive B mounted inside the body A1, and a start switch B1 disposed at the bottom side of the body A1 and adapted to control the operation of the motor drive B. The motor drive B comprises a transmission gear set B2 adapted to move the head A2, the wings A3, and the tail A5, a rotary wheel B3, a link B4 obliquely coupled to the rotary wheel B3 and adapted to lift the legs A4 from the floor and to push the motion toy ahead for one step upon each turn during rotation of the rotary wheel B3. This motion toy A cannot simulate the real motion of a living duck in a fine way. Because the swings are monolithic members simply driven to oscillate up and down, they do not show the streamlined beauty of the motion of the wings of a living duck.

SUMMARY OF THE INVENTION

The present invention has been accomplished under the circumstances in view. It is the main object of the present invention to provide a motion toy, which simulates the fine action of the swinging of the wings of a bird, showing a streamlined beauty.

To achieve these and other objects of the present invention, the motion toy comprises a swinging mechanism provided at the back side of the toy body. The swinging mechanism comprises a driving module, two swinging arm assemblies symmetrically coupled the driving module at two sides, two endpieces respectively coupled to the swinging arm assemblies remote from the driving module, and coupling devices coupling the swinging arm assemblies to the driving module and the endpieces to the swinging arm assemblies for enabling the swinging arm assemblies to swing and the endpieces to follow the swinging arm assemblies to swing upon operation of the driving module. The coupling devices can be hinges, slip joints, flexible connecting members, or the like that allow two linked members to be moved relative to each other.

DETAILED DESCRIPTION OF THE PREFERRED EMBODIMENT

Figure 1:
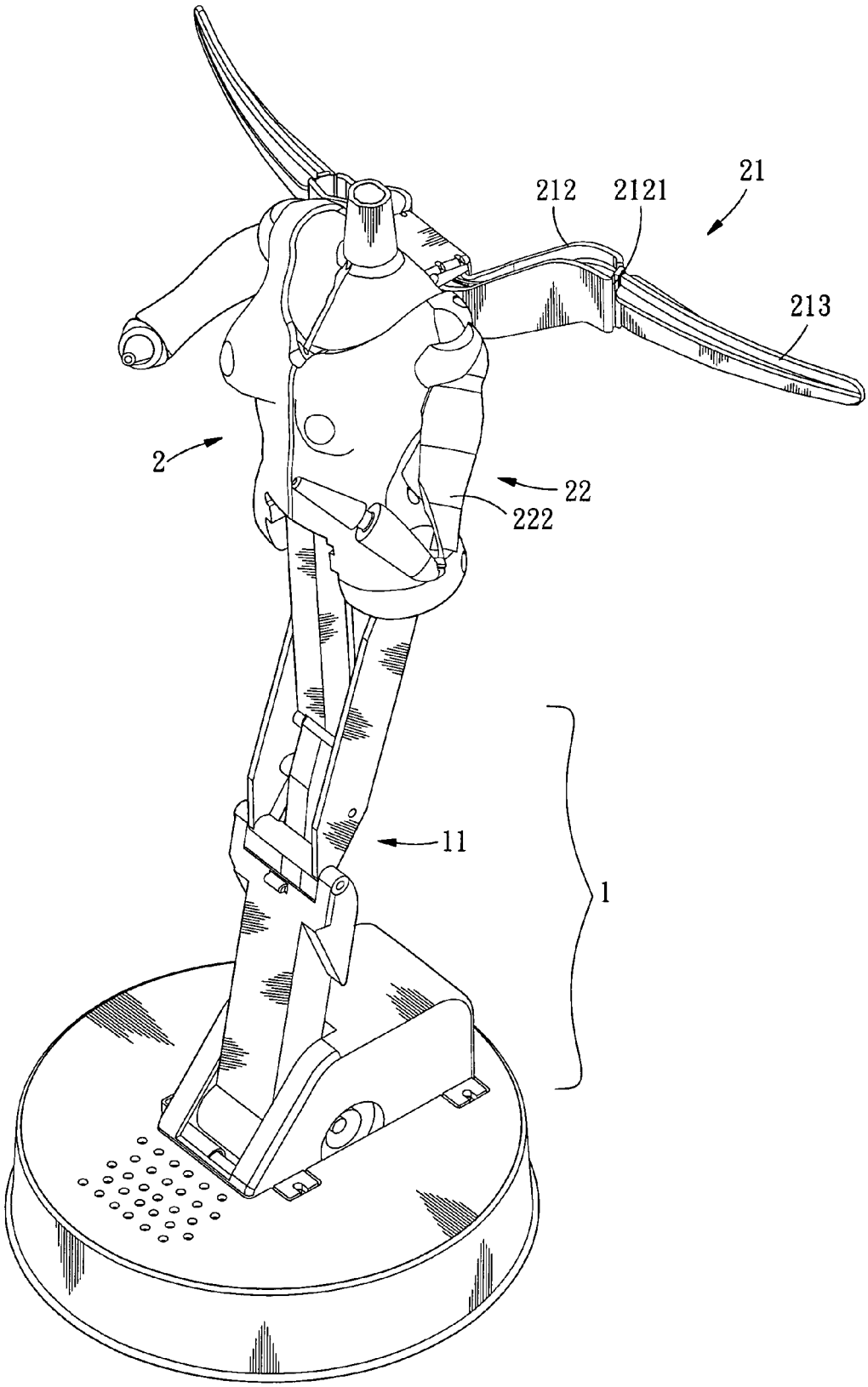
FIG. 1 is a perspective view of a motion toy according to the present invention.

Referring to FIG. 1, a motion toy is shown comprising a base 1, and a toy body 2.

The base 1 comprises a support arm assembly 11 upwardly extended from the top side and connected to the toy body 2.

The toy body 2 comprises a swinging mechanism 21 and a swiveling mechanism 22.

Figure 2:
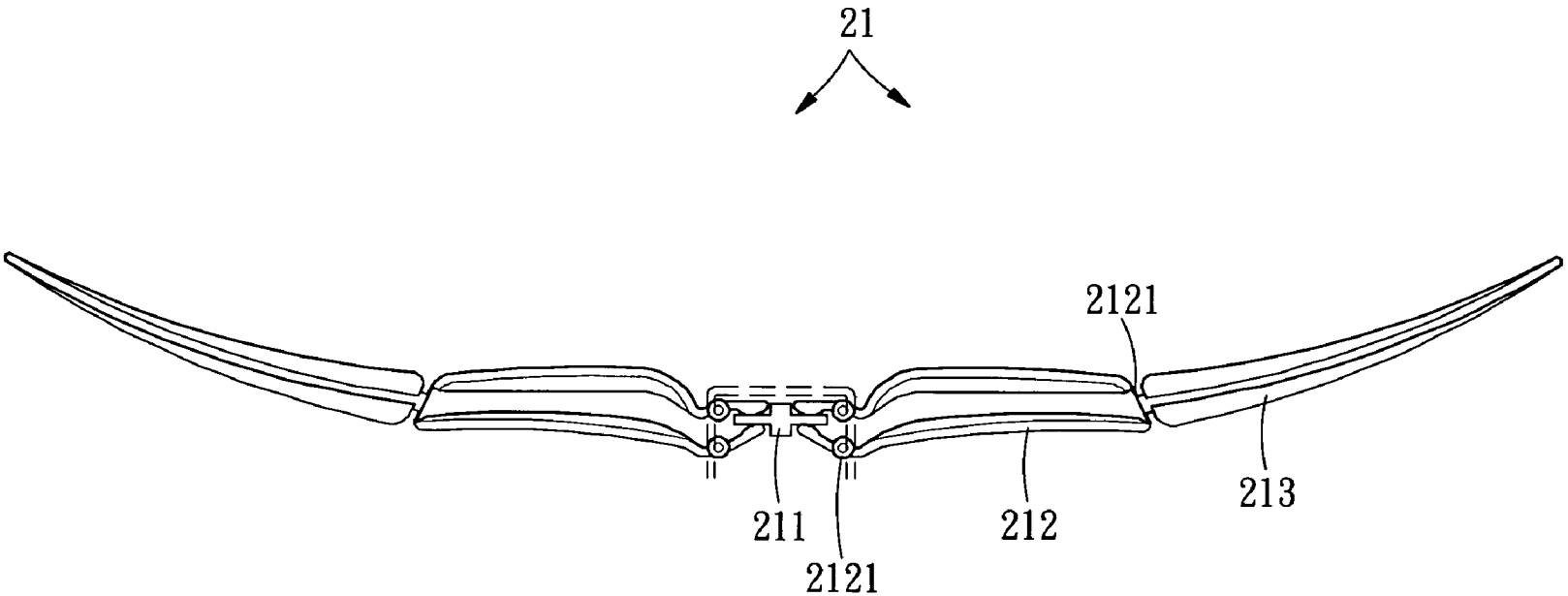
FIG. 2 is a schematic top view showing the motion of the swinging mechanism of the motion toy according to the present invention (I).
Figure 3:
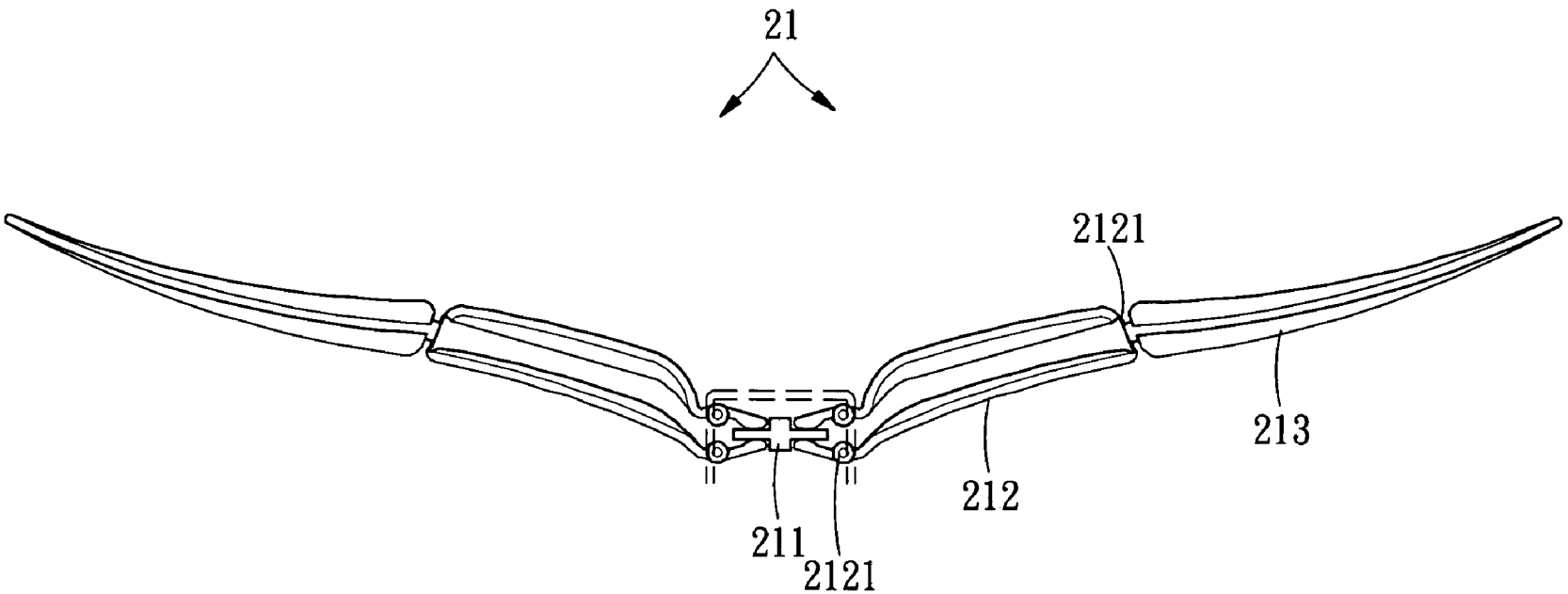
FIG. 3 is a schematic top view showing the motion of the swinging mechanism of the motion toy according to the present invention (II).
Figure 4:
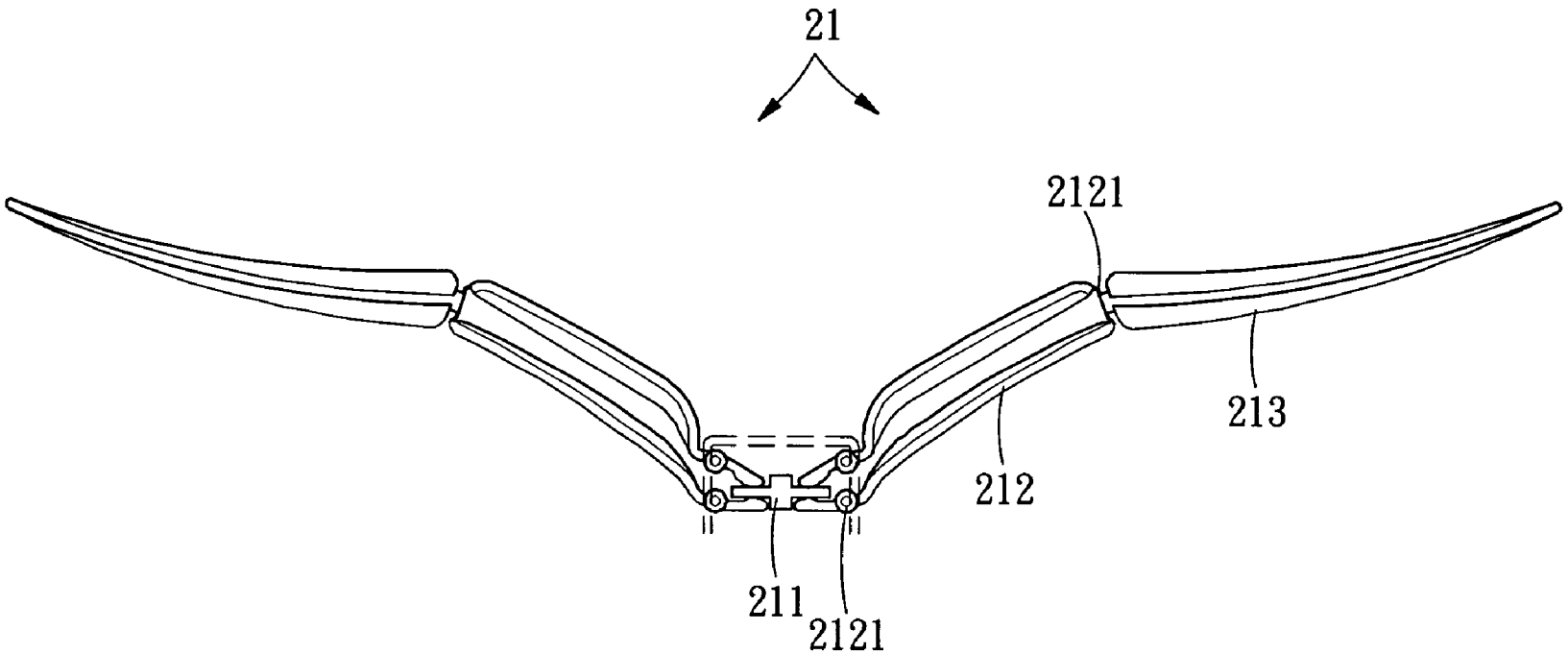
FIG. 4 is a schematic top view showing the motion of the swinging mechanism of the motion toy according to the present invention (III).

Referring to FIGS. 2~4, the swinging mechanism 21 comprises a driving module (for example, a motor drive) 211, two pairs of parallel swinging arms 212 symmetrically coupled to the driving module 211 at two sides, two endpieces 213 respectively coupled to the swinging arms 212 remote from the driving module 211, and a plurality of coupling devices 2121 respectively connected between the driving module 211 and the swinging arms 212 and between the swinging arms 212 and the endpieces 213. When starting the driving module 211, the swinging arms 212 are driven to swing horizontally back and forth, and the endpieces 213 are forced by to move with the swinging arms 212 by the swinging force of the swinging arms 212. Because the endpieces 213 are forced by to move with the swinging arms 212 by the swinging force of the swinging arms 212, a moderate swinging motion of the endpieces 213 is seen relative to the swinging arms 212 during swinging of the swinging arms 212.

Figure 5:
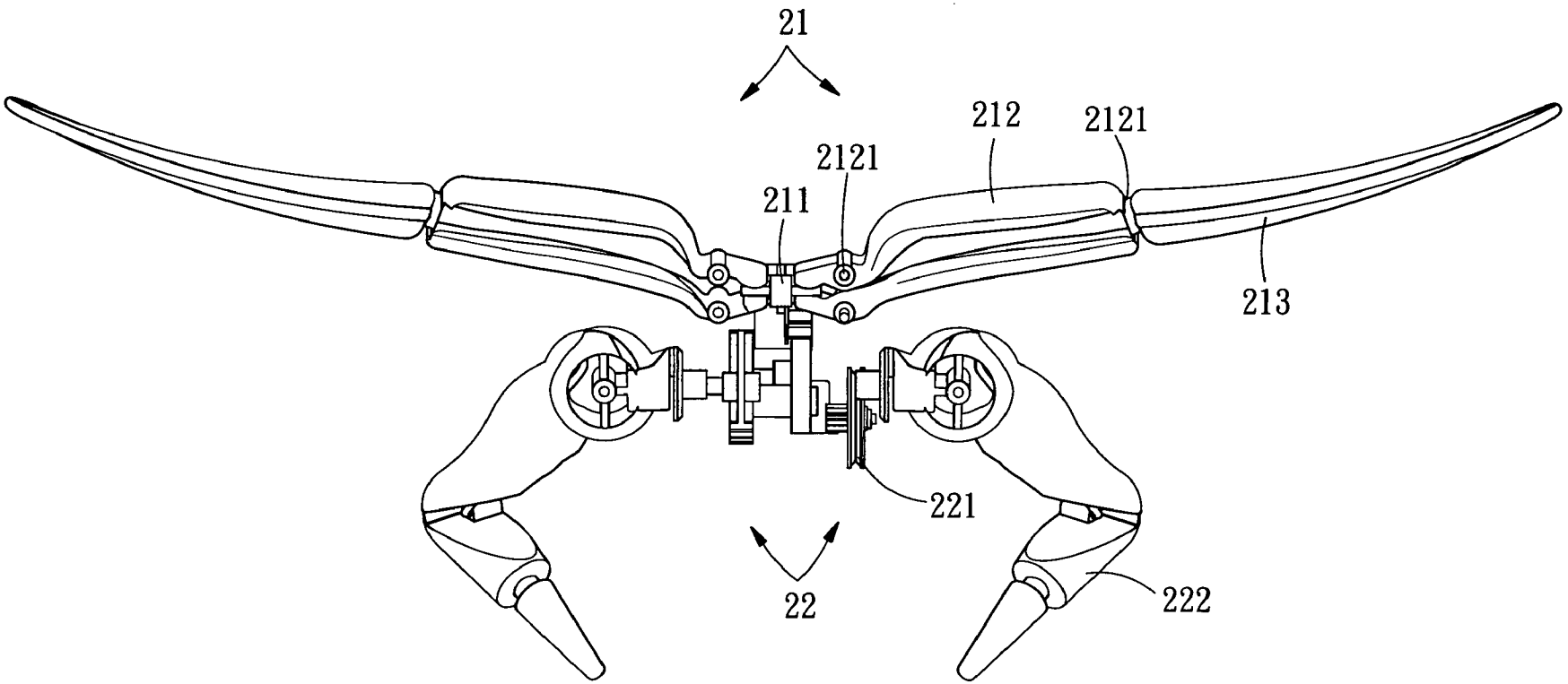
FIG. 5 is a top view of the motion toy according to the present invention.
Figure 6:
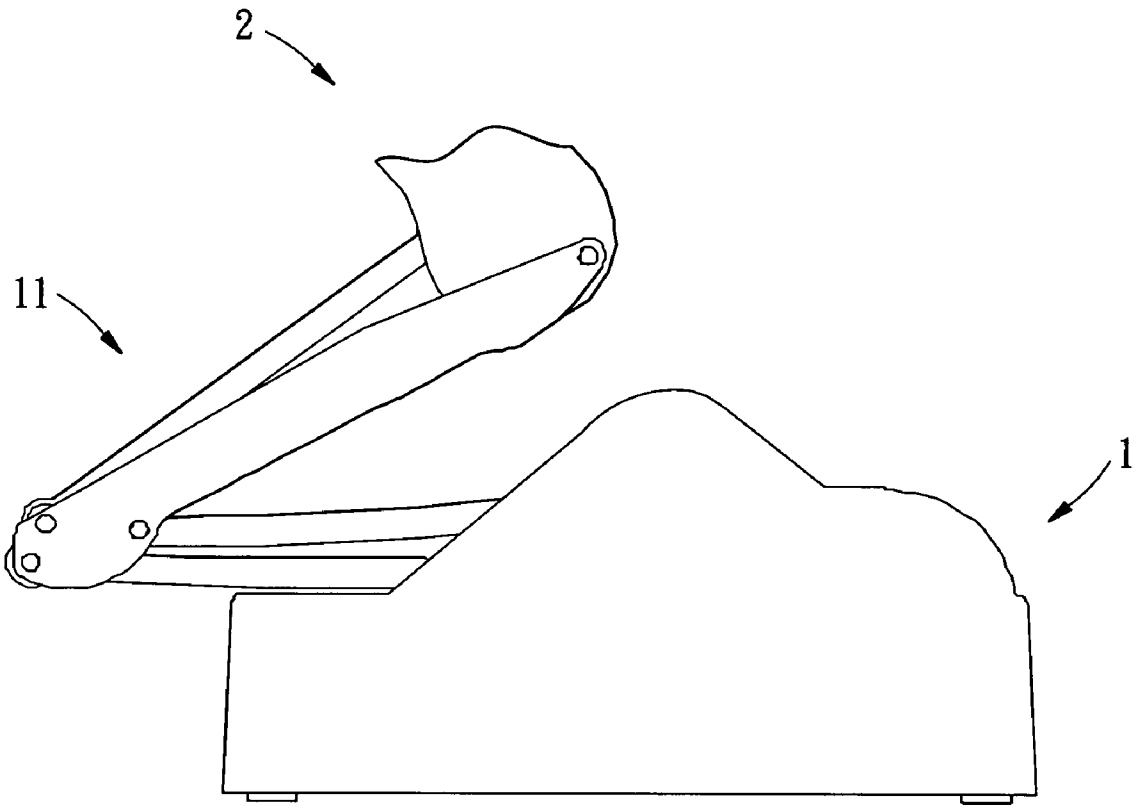
FIG. 6 is a side view of the support arm assembly of the motion toy according to the present invention.

Referring to FIGS. 5 and 6, the swiveling mechanism 22 comprises two swivel arms 222 pivoted to the toy body 2, and a transmission module, for example, a transmission gear set 221 mounted inside the toy body 2 and coupled between the driving module 211 and the swivel arms 222. The transmission gear set 221 and the swivel arms 222 can be so arranged that the swivel arms 222 are synchronously turned forwards and backwards during operation of the driving module 211. Alternatively, the transmission gear set 221 and the swivel arms 222 can be so arranged that the swivel arms 222 are reversely turned forwards and backwards during operation of the driving module 211. Further, the support arm assembly 11 can be driven by a motor drive or the like (not shown) in the base 1 to lift and lower the toy body 2 alternatively. Further, the aforesaid coupling devices 2121 can be hinges, slip joints, or flexible connecting members, for example, rubber or silicon rubber members connected between each two component parts of the swinging mechanism 21.

Figure 7:
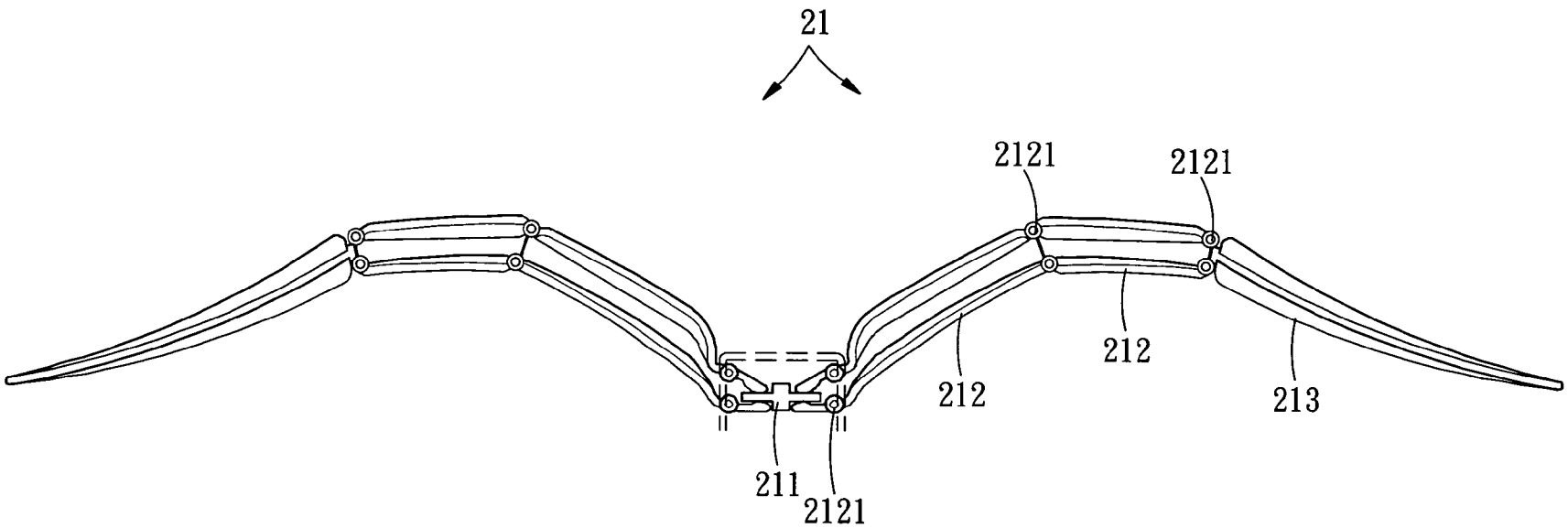
FIG. 7 is a top view of an alternate form of the swinging mechanism according to the present invention.
Figure 8:
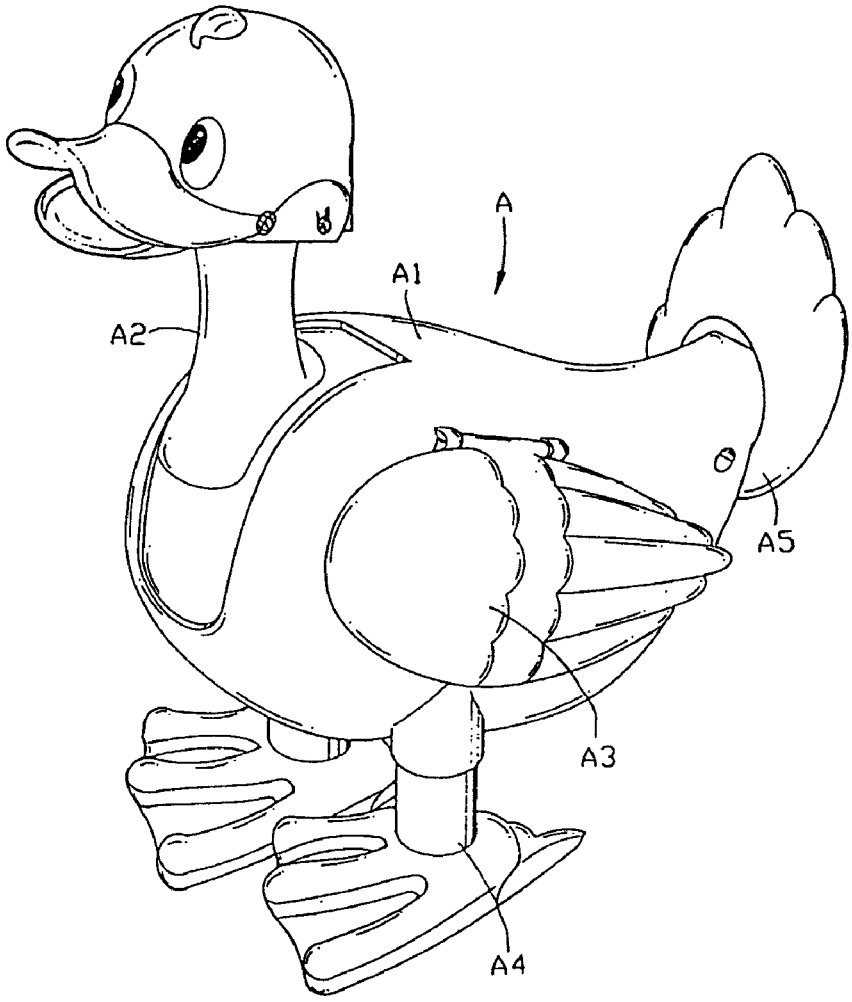
PRIOR ART FIG. 8
FIG. 8 is an elevational view of a motion toy according to the prior art.
Figure 9:
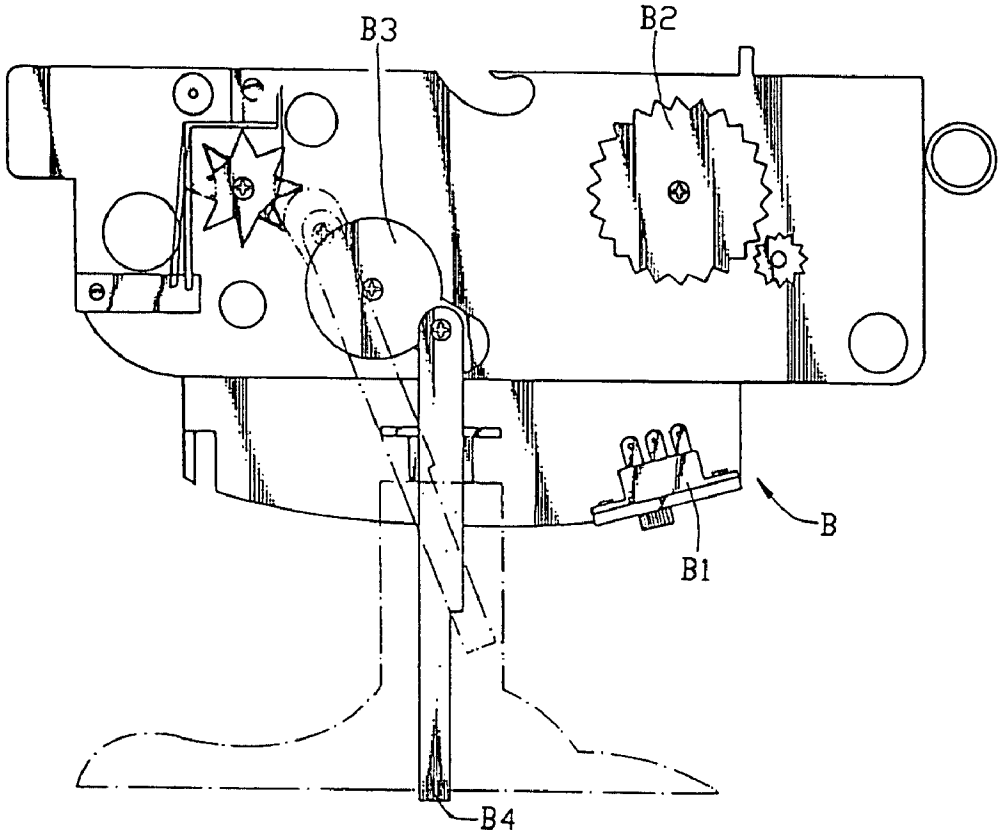
PRIOR ART FIG. 9
FIG. 9 is a sectional view showing the arrangement of the driving mechanism according to the prior art.

FIG. 7 shows an alternate form of the swinging mechanism according to the present invention. According to this embodiment, the swinging mechanism 21 comprises two swinging arm units coupled to the driving module 211 at two sides, each swinging arm units comprising two coupling device 2121 of parallel swinging arms 212.

As indicated above, the swinging mechanism 21 uses coupling devices 2121 to connect the endpieces 213 to the swinging arms 212 and the swinging arms 212 to the driving module 211 such that the movable parts at each side of the swinging mechanism 21 are alternatively moved one after another, simulating the swinging motion of the wings of a bird or the like. The fine motion of the motion toy greatly attracts the consumers to buy.

A prototype of motion toy has been constructed with the features of FIGS. 1~7. The motion toy functions smoothly to provide all of the features discussed earlier.

Although particular embodiments of the invention have been described in detail for purposes of illustration, various modifications and enhancements may be made without departing from the spirit and scope of the invention, for example, the toy body can be provided with a plurality of swinging mechanisms disposed at different elevations. Accordingly, the invention is not to be limited except as by the appended claims.

What is claimed is:

1. A motion toy comprising a toy body, and at least one swinging mechanism provided at said toy body, said at least one swinging mechanism each comprising a driving module, two swinging arm assemblies symmetrically coupled said driving module at two sides and adapted to swing upon operation of said driving module, two endpieces respectively coupled to said swinging arm assemblies remote from said driving module, and a plurality of coupling devices adapted to couple said swinging arm assemblies to said driving module and said endpieces to said swinging arm assemblies for enabling said swinging arm assemblies to swing and said endpieces to follow said swinging arm assemblies to swing upon operation of said driving module, wherein said swinging arm assemblies each comprise at least two pairs of swinging arms respectively coupled between said driving module and said endpieces.

2. The motion toy as claimed in claim 1, wherein said at least one swinging mechanism includes a plurality of swinging mechanisms disposed at different elevations.

3. The motion toy as claimed in claim 1, wherein each said swinging arm of each said swinging arm assembly is comprised of at least two hinged movable parts.

4. The motion toy as claimed in claim 1, wherein said coupling devices are hinges.

5. The motion toy as claimed in claim 1, wherein said coupling devices are slip joints.

6. The motion toy as claimed in claim 1, wherein said driving module is a motor drive.

7. The motion toy as claimed in claim 1, further comprising a base and a support arm assembly coupled between said base and said toy body and adapted to lift and lower said toy body.

8. The motion toy as claimed in claim 1, further comprising two swivel arms bilaterally pivoted to said toy body, and transmission mechanism coupled between said swivel arms and said driving module for enabling said driving module to move said swivel arms.

9. The motion toy as claimed in claim 8, wherein said transmission mechanism moves said swivel arms forwards and backwards synchronously upon operation of said driving module.

10. The motion toy as claimed in claim 8, wherein said transmission mechanism moves said swivel arms alternatively forwards and backwards in reversed directions upon operation of said driving module.

11. A motion toy comprising a toy body, and at least one swinging mechanism provided at said toy body, said at least one swinging mechanism each comprising a driving module, two swinging arm assemblies symmetrically coupled said driving module at two sides and adapted to swing upon operation of said driving module, two endpieces respectively coupled to said swinging arm assemblies remote from said driving module, and a plurality of coupling devices adapted to couple said swinging arm assemblies to said driving module and said endpieces to said swinging arm assemblies for enabling said swinging arm assemblies to swing and said endpieces to follow said swinging arm assemblies to swing upon operation of said driving module, and two swivel arms bilaterally pivoted to said toy body, and transmission mechanism coupled between said swivel arms and said driving module for enabling said driving module to move said swivel arms.

12. The motion toy as claimed in claim 11, wherein said at least one swinging mechanism includes a plurality of swinging mechanisms disposed at different elevations.

13. The motion toy as claimed in claim 11, wherein said swinging arm assemblies each comprise at least two pairs of swinging arms respectively coupled between said driving module and said endpieces.

14. The motion toy as claimed in claim 13, wherein each said swinging arm of each said swinging arm assembly is comprised of at least two hinged movable parts.

15. The motion toy as claimed in claim 11, wherein said coupling devices are hinges.

16. The motion toy as claimed in claim 11, wherein said coupling devices are slip joints.

17. The motion toy as claimed in claim 11, wherein said driving module is a motor drive.

18. The motion toy as claimed in claim 11, further comprising a base and a support arm assembly coupled between said base and said toy body and adapted to lift and lower said toy body.

19. The motion toy as claimed in claim 11, wherein said transmission mechanism moves said swivel arms forwards and backwards synchronously upon operation of said driving module.

20. The motion toy as claimed in claim 11, wherein said transmission mechanism moves said swivel arms alternatively forwards and backwards in reversed directions upon operation of said driving module.

* * * * *